United States Patent [19]

Avitzur

[11] 3,934,446

[45] Jan. 27, 1976

[54] METHODS OF AND APPARATUS FOR PRODUCTION OF WIRE

[76] Inventor: Betzalel Avitzur, 817 N. 31st St., Allentown, Pa. 18104

[22] Filed: Apr. 16, 1974

[21] Appl. No.: 461,307

[52] U.S. Cl. ..... 72/206; 72/262

[51] Int. Cl.[2] ..... B21B 21/00

[58] Field of Search ..... 72/206, 256, 262, 263, 72/92, 93, 64, 65, 233, 231

[56] References Cited

UNITED STATES PATENTS

| | | | |
|---|---|---|---|
| 3,143,786 | 8/1964 | Jones | 72/206 |
| 3,184,943 | 5/1965 | Ware | 72/206 |
| 3,525,096 | 8/1970 | Klenz | 72/206 |
| 3,765,216 | 10/1973 | Green | 72/262 |

*Primary Examiner*—C. W. Lanham
*Assistant Examiner*—Robert M. Rogers
*Attorney, Agent, or Firm*—Seidel, Gonda & Goldhammer

[57] ABSTRACT

Methods of and apparatus for the production of wire are presented. Previously, the most economic and popular process was drawing. In each pass, a small reduction was obtained and normally several dies in tandem were mounted on a single wire drawing machine. The process was continuous and precision wire was made. Also in the prior art, traditional rolling was a continuous process, but was limited to heavy and medium gauge, to small reductions per pass, and to poor dimensional and surface control. In comparison, traditional extrusion and hydrostatic extrusion are capable of large reductions, good dimensional control and surface finish, but are limited to finite wire or rod length. The more recent concepts of: continuous extrusion with viscous drag, continuous chamber extrusion, continuous extrusion forming, combined hydrostatic extrusion and drawing for fine wire and helical extrusion are compared and their advantages and shortcomings are discussed.

A family of new processes of and apparatus for combining extrusion and rolling, utilizing the friction drag provided by rolling with open chamber extrusion is described. A continuous process, with large reductions and good dimensional control, can be achieved.

22 Claims, 17 Drawing Figures

METHODS OF AND APPARATUS FOR PRODUCTION OF WIRE

BACKGROUND OF THE INVENTION

1. Field of the Invention

This invention relates methods of and apparatus for the production of wire. Accordingly, it is a general object of this invention to provide new and improved methods and apparatus of such character.

2. Description of the Prior Art a. Forward

In the production of wire and rod of all shapes and cross sections, the processes of wire drawing, rod rolling and extrusion are the conventional production methods. One or the other of the following two limiting factors plagues each of these processes. By the processes of wire or rod drawing or rolling one can accomplish only small reductions per pass. For larger reductions, successive passes must be followed. The process, however, can then be done as a steady state continuous process with little interruptions. In the process of extrusion, larger reductions can be made in a single pass, but only finite lengths can be extruded and the process is intermittent.

In the search for a truly continuous process, with large reductions per pass, the following four recent processes were proposed and developed:

1. Continuous Extrusion with Viscous Drag by Fuchs — See: Fuchs, F. J., Wire Jr. 105 October, (1970)
2. Continuous Chamber Extrusion by Fuchs — See: Fuchs, F. J., and Schmehl, G. L., "Continuous Hydrostatic Extrusion", presented and published, NEL/AIRAPT International Conference on Hydrostatic Extrusion, University of Sterling, Scotland, June 13–15, 1973.
3. Continuous Extrusion Forming by Green — See: Green, D., "Continuous Extrusion - Forming of Wire Sections", Jr. of the Inst. of Metals, Vol. 100, 1972.
4. Combined Extrusion Drawing for Fine Wire.

Eash process is described briefly, its concept explained and its shortcomings pointed out.

b. Continuous Extrusion with Viscous Drag

The development by Dr. Fuchs of Western Electric, as reported in Wire Jr., 105 (1970), utilizes viscous drag as the motivating force for the extrusion of continuous rod of aluminum or copper. In principle, the liquid passing through a narrow gap between a chamber and a rod drags the rod forward by viscous drag. To maintain flow, a pressure drop prevails between the pressure at an entrance on the back side of the chamber and an exit at the front. Only a small differential pressure can be maintained in each chamber. The difference in pressure between entrance and exit must be below the flow strength of the workpiece material to prevent pinch off. Thus, only low drag and small reductions can be made by the use of a single chamber. In one embodiment, the chambers are piggybacked in tandem to effect large reductions. The highest-pressure chamber is in front, discharging through a passage into a lower-pressure chamber behind it. The discharge from chamber to chamber proceeds, until at the last chamber, the exit pressure is atmospheric. Thus, if the entrance pressure to the first chamber is (say) 200,000 psi, a gradual drop prevails toward the entrance to the chamber at the back. Because of the forward motion of the rod, a small gap around the rod at the walls between chambers does not leak. A rolled or extruded rod could be reduced to final telephone wire size in a single die by a single pass.

This process was apparently abandoned due to poor efficiency. The applicant has calculated the expected power consumed by shear in the liquid itself and has determined that maximum efficiency expected theoretically is in the vicinity of 30%. This 30% efficiency could only be achieved when pressure approaches infinity and the gap between the rod and the chamber approaches zero. Such conditions can not exist in practice. Furthermore, approaching such conditions, the process becomes very unstable and any change in pressure or size of the rod throws the process out of balance.

Thus, due to inefficiency, such process becomes unacceptable for economical production application.

c. Continuous Chamber Extrusion

To avert the shortcomings of the continuous viscous drag extrusion, a continuous segmented chamber extruder, has been developed, as reported by Fuchs, F. J., and Schmehl, G. L., "Continuous Hydrostatic Extrusion", presented and published, NEL/AIRAPT International Conference on Hydrostatic Extrusion, University of Sterling, Scotland, June 13–15, 1973. The continuous chamber is made from matching segments moving in a chainlike manner. Four circumferentially segmented parts form together a short length of the chamber. Longitudinally, many segments form the length of the chamber which is open on both ends. The segments move together parallel to the axis of symmetry of the chamber. They separate at the exit in order to get away from the chamber they formed and then return to the entrance side where they meet again to form the chamber with their matching counter-parts. A die is set at the exit and a rod is fed at the entrance. The rod is squeezed and dragged by the segmented chamber, moving with it towards the die. To enhance the drag, the rod is coated with plastic material before entering the machine. The rod is machined to close tolerances before coating to fit snugly in the chamber. As the rod reaches the die, the drag produces enough pressure to force extrusion through the die. Very little relative motion is expected between the moving chamber and the rod, so that friction losses are minimized.

The motivation mechanism to mobilize the chamber components and the matching of the components requires a high degree of precision. Cleanliness must be maintained to avoid gaps between the matching segments, through which fins from the deforming workpiece might squeeze. Besides being precision made, the mechanism must be highly rigid to produce and withstand the high operating pressures and forces.

Preparation of the raw material to enter the machine (dimensioning and coating) and the watchmakers' precision, combined with massivity demands from the production machine parts and assembly, are the major shortcomings of such machines.

d. Continuous Extrusion Forming

A development by D. Green of the British Atomic Energy Agency, reported at "Continuous Extrusion-Forming of Wire Sections", Jr. of the Inst. of Metals, Vol 100, 1972, employs friction between a workpiece and a tool as the motivating force for continuous extrusion. There, in an explanatory model which describes the principles, a die with a hole is attached to a stationary platen. A top platen with a square groove is mounted over the bottom stationary platen. Together, they form a square chamber with a block closing the left end; the hole in the block is the die opening. The right end of the chamber is open. A round rod is placed in the chamber, touching at the four surfaces. Then, the top platen is made to slide towards the die. Friction from the three sides of the moving platen drags the rod toward the die, where the rod is blocked. Please note that friction from the top platen exceeds and overcomes resistance by friction from the bottom platen. The friction effect on the rod is to upset the rod. The more the rod is upset, the more effective the friction drag becomes. As it comes closer and closer to the die, more contact prevails between the workpiece and the four walls. At the die, the round original rod has already deformed into a square rod. Pressure is high enough to effect an extrusion through the die. As a bonus, the design is made so as to leave a small gap between the die block and the moving platen. Through this gap, a thin chip is discarded, removing the undesired surface of the rod. Standard extruded or rolled stock serves as the workpiece.

When the stationary platen is replaced by a stationary semi-circular member, and the moving platen by a rotating cylindrical tool, a continuous process is established.

The two major factors restricting the efficiency of such process are the redundant work of upsetting the incoming wire and friction losses. The redundant work is due to an upsetting of the original round wire to a square (and then starting from a square rather than a round — through the die). This work is independent of the attempted reduction. The friction losses in the square channel depend both on friction values and on reduction.

e. Combined Extrusion Drawing for Fine Wire

One of the shortcomings of the process of hydrostatic extrusion is the finite length of an extruded billet. Since the process of wire drawing has the advantage of being a continuous process, the problem of overcoming the batch-interrupted nature of hydrostatic extrusion has long been with us.

When a spool of wire is inserted into a cylindrical chamber, longer runs can be made. Simple spools can be used, and spinning reels and standing reels have been explored at Battelle, as set forth in U.S. Pat. No. 3,328,998, "High Reduction Drawing", By Sabroff, A. M., and Fiorentino, R. J. — July, 1967, and by Pugh of the National Engineering Laboratories in Scotland, in "The Mechanical Behavior of Materials Under Pressure", FIG. 41 of Chapter 9, "Hydrostatic Extrusion", Elsevier Materials Science Series, 1970, Pugh, H. Ll. D., (Editor). When the extrusion pressure is augmented by a pull, a Robertson process is provided, as described by J. Robertson at "Method of and Apparatus for Forming Metal Articles", British Pat. No. 19,356, October 14, 1893; U.S. Pat. No. 524,504, August 14, 1894. Hundreds of thousands of feet of fine wire, (<0.001 inch), used in the solid state industries, can be spooled and inserted into a ¾ inch bore chamber to provide very long runs between loadings. Delicate instrumentation to relate chamber pressure to augmenting tension controls is essential for such equipment. Development work along these lines is followed internationally. With present day limited chamber size, only very fine wire production is expected to be economically competitive for this process.

It should be noted that very long wire can be made, but the process is not a truly continuous process.

f. Helical Extrusion

Another process by Green is called Helical Extrusion. There, hydrostatic extrusion is combined with a chip forming process to produce a small gauge wire (of all shapes) directly from an ingot. Reductions of thousands to one are obtained. Because of the involved concept, this prior-art process is not described herein. Very long wire can be made, but the process is not truly continuous. Each ingot is loaded separately.

g. Comparisons of Alternate Processes

In Table I, the alternate possible processes for the production of wire and rod are tabulated vertically. Criteria for the comparison of major characteristics of those processes are listed horizontally, thus obviating the necessity for deliberation. The process of "extrolling" the newly proposed process of this invention, in included.

TABLE I

COMPARISONS OF ALTERNATE PROCESSES

| Process / Property | Product length | Reduction possible | Speed | Power efficiency | Design characteristics | Dimensional, surface & internal damage | Other comments |
|---|---|---|---|---|---|---|---|
| Rolling | Unlimited | Small | High | High | Simple, few moving parts, rugged | Poor | |
| Conventional extrusion | Short | Large | Moderate | Moderate | Simple, few moving parts, rugged | Fair | |
| Wire drawing | Unlimited | Small | High | High | Simple, reliable | Good | |
| Continuous extrusion with viscous drag | Unlimited | Large | Very high* | Excessively poor | Complicated, but few moving parts | Good | *Limited only by ability to collect product |
| Continuous chamber extrusion | Unlimited | Large* | Moderate to high | Claimed highest in trade | Complicated, many moving parts** | Good | *Reported 300 to 1 in copper at up to 300,000 psi pressure **Requires high precision combined with rigidity & many moving parts that must fit one to each other |
| Continuous extrusion forming | Unlimited | Large | High | Fair to poor | Simple, few moving parts, rugged | Good | |
| Combined hydrostatic extrusion and drawing for fine wire | Very long | Moderate to large | Highly restricted | Poor but not a factor | Complicated and delicate | Very good | |
| Helical extrusion | Very long | Sky high | Moderately high | ? | Complicated, but rugged | Good | |

TABLE I-continued

COMPARISONS OF ALTERNATE PROCESSES

| Process | Property | Product length | Reduction possible | Speed | Power efficiency | Design characteristics | Dimensional, surface & internal damage | Other comments |
|---|---|---|---|---|---|---|---|---|
| "Extrolling" | | Unlimited | Moderately high | High | Fair to high | Simple, few moving parts, rugged | Good | |

SUMMARY OF THE INVENTION

Another object of this invention is to provide new and improved methods of and apparatus for the production of wire which can be produced in a continuous process with large reductions and with good dimensional control.

Yet another object of this invention is to provide new and improved methods of and apparatus for producing wire by combining rolling and extrusion, utilizing the friction drag provided by the rolling with an open chamber extrusion.

In accordance with this invention, wire can be formed by utilizing a pair of opposed rotating rollers for upsetting an incoming rod of material in a rolling manner, and then extruding the upsetted rod to form wire thereby.

In accordance with an embodiment of the invention, a method of producing wire includes initially, grasping an incoming rod of material by a groove of a first rotating member. The groove has a dimension less than that of the incoming rod so that the rod, when initially grasped by the groove, is deformed to fit thereunto. Then, a force is applied to an external surface of the grasped incoming rod. A normal component thereof urges the grasped rod further into the groove. A tangential component is provided by a second rotating member having a circumferential speed equal to that of the first rotating member. The rod, then, is pushed through a die to form wire therefrom.

In accordance with another embodiment of the invention, suitable apparatus for forming wire includes a first roller having a circumferential groove with a width somewhat less than that of an incoming rod to be worked. The incoming rod is frictionally held by the groove. A second roller, rotatable about an axis parallel to the axis of the first roller, has a circumferential projection thereon. The two rollers are so oriented so that the projection and the groove, when in cooperating relationship, form an opening therebetween. The opening, at a plane common to the two axes, has a cross-sectional area less than that of the cross-sectional area of the incoming rod. Thus, the incoming rod, when forced within the opening, becomes upset. Suitable means rotate the first roller. A die is fixed in location with respect to both rollers so that the upsetted rod, when fed between both rollers, is extruded through the fixed die to form wire therefrom. In accordance with other features of the invention, the second roller is rotated at the same linear velocity as that of the first roller. A third roller with an axis parallel to the two axes is oriented with respect to the first roller so as to initially engage the incoming rod and to force at least a portion of the rod into the groove of the first roller, prior to the incoming rod coming into contact with the projection of the second roller. The third roller can be rotated at a linear velocity in excess of that of the first roller. Other features include the groove of the first roller and the projection of the second roller having rectangualr configurations. The groove of the first roller can have a U-shape configuration and the projection of the second roller can have a concave configuration.

In accordance with an embodiment of the invention, apparatus for forming an incoming rod into a wire includes means for grasping the incoming rod at three contact points thereof, namely at two opposed sides and a bottom in a concave hold, and means for rotating the grasped rod about a first axis. Means rotatably apply a projection against the top surface of the grasped rod about a second axis parallel to the first axis. The central axis of the rod, at a point where grasped, is perpendicular to a plane common to both axis, whereby the rod becomes upset in a shape determined by the grasping means and the projection application means. The upsetted rod is pushed through a fixed die having a diameter less than a thickness of the rod so as to extrude a wire therefrom.

One concept of the invention includes apparatus for forming an incoming rod into a wire, wherein a first rotatable means includes a groove for grasping the rod. A protrusion on a second rotatable means contacts the grasped rod so as to upset the grasped rod into a shape determined by the protrusion and the groove. The upsetted rod is then pushed through a die so as to form wire thereby. The die has an opening therein having a dimension less than the smallest external dimension of the rod.

In still another embodiment of the invention, apparatus for forming wire includes means for passing an incoming rod of material having a first cross-sectional area through a pair of opposed members which rotate about parallel axes. The opposed rotating members have external cylindrical surfaces which cooperates so as to form a second cross-sectional area in the plane common to the axes. The second cross-sectional area is less than that of the first cross-sectional area so that the rotating members upset the incoming rod in a rolling manner. The upsetted incoming rod is passed through a fixed die, being extruded therethrough, to form wire at an external orifice thereof.

Wire can be formed by apparatus having first rotatable means with a groove thereon having a dimension less than that of an incoming rod to be grasped so that an incoming rod, upon being initially held against the groove, is deformed to fit thereinto. Second rotatable means, adapted to have a linear circumferential speed equal to that of the first rotatable means, forces the incoming rod further into the groove of the first rotatable means. The forced rod is extruded through a die to form wire therefrom.

Apparatus, in accordance with this invention, for forming wire can include a first circumferential member for grasping an incoming rod. The member has a groove with a dimension less than those of the rod to frictionally hold the rod. A second circumferential member, rotatable about its axis, has an exterior circumferential surface which cooperates with the grasping member, so that at least a portion of the incoming rod is held about its entire periphery. The grasping member is rotated so as to extrude the held rod through a die. In accordance with certain features of the invention, the apparatus includes means for rotating the circumferential member at the same linear speed as the grasping member. The apparatus can include a third circumferential member for urging the incoming rod against the first member prior to the rod coming into contact with the second member. The third circumferential member is rotated at a linear circumferential velocity greater than that of said first member.

In accordance with the invention, apparatus for forming wire can include a pair of opposed rollers for engaging an incoming rod of material and for frictionally grasping and for deforming the rod into a cross-sectional shape as determined by the configurations of the opposed rollers. The cross-sectional shape is less than that of the initial cross-sectional area of the incoming rod, thereby upsetting the incoming rod. Suitable means extrude the upsetted rod.

In accordance with a particular embodiment of the invention, wire is formed by feeding an incoming rod of material having a fixed diameter into a circumferential groove of a circular roller, wherein the width of the groove is less than the diameter of the rod. The incoming rod is deformed by forcing the incoming rod into the groove so that the incoming rod is frictionally held by the roller. The held rod is upset by applying a projection from an opposed roller which engages with an opposed surface of the held rod so that the rod is frictionally held by both rollers. The rod is extruded by applying an axial force to the held rod by the rollers. The axial, friction motivated force produces a bulge and creates a lateral force. This lateral force increases as the die is approached. At the die the lateral pressure is high enough to affect the extrusion through the die to form wire therefrom.

In accordance with the invention, a method for forming an incoming rod into wire includes grasping the rod about three contact points thereof, namely at two opposed sides and a bottom, by a rotating groove shaped member. A protrusion-shaped member is applied into mating contact with the incoming rod, at the top surface thereof, so as to upset the rod into a shape defined by the protrusion and the groove. The members are rotated at the same linear speed so as to frictionally push the upsetted rod through a die having a diameter less than the external dimensions of the incoming rod so as to extrude wire therefrom.

In accordance with an embodiment of the invention, wire is formed by rolling an incoming rod of material, having a first cross-sectional area, through a pair of opposed members which rotate about axes parallel to each other. The rotating members have external circumferential surfaces which cooperate so as to form a second cross-sectional area in a plane common to both axes. The second area is less than that of the first, so that the rotating members apply frictional forces to the incoming rod in a rolling manner, thereby upsetting the rod. Then, the upsetted rod is extruded through a fixed die to form wire therefrom.

In accordance with the invention, wire can be formed by grasping an incoming rod of material by a member having a groove therein with a dimension less than that of the incoming rod, so that, when grasped, the rod becomes deformed within the groove and is held thereby. The member is rotated so that the held incoming rod comes into contact with an opposed rotating member which has a protrusion thereon so as to further force the incoming rod further into the groove, whereby the rod is frictionally held by both members. The held rod is extruded by frictionally pushing the rod about its circumferential surfaces through a die to form wire therefrom.

In accordance with one version of the invention, wire is formed by grasping an incoming rod of material by a circumferential groove of a first rotatable member having a dimension less than the dimension of the incoming rod, so that the rod is frictionally held by the groove. The held portion of the rod is rotated passed a second rotatable member which has an exterior circumferential surface so as to cooperate with the incoming rod portion to hold the rod within the groove of the first member so that the rod portion is held about its entire periphery by both the groove of the first member and the circumferential surface of the second member. The rod is then extruded by pushing the rod through a die to form wire. In accordance with one feature of the invention, the second member is idle. In accordance with another feature of the invention, both members are rotated individually at the same linear circumferential speed. With a different feature of the invention, a third rotatable member urges the incoming rod against the first member prior to the rod coming into contact with the second member. The third member is rotated at a higher circumferential linear speed than the first member. Alternatively, the third member may be idled.

In accordance with the invention, wire is drawn and extruded by engaging an incoming rod of material with a pair of opposed rollers which are formed to frictionally grasp and deform the rod into a cross-sectional shape as determined by the rollers, the shape being less than, equal to, or larger than the cross-sectional area of the incoming rod, whereby the incoming rod becomes upset. The upsetted rod is extruded through a die to form wire.

In accordance with yet another embodiment of the invention, wire is formed by feeding an incoming rod of material which has a fixed diameter into the groove of a first circular roller wherein the width of the groove is less than the diameter of the incoming rod, deforming the incoming rod by forcing the rod into the groove so that the rod is frictionally held by the roller, upsetting the held rod by applying a projection from an opposed second roller which engages with an exposed surface of the rod so that the rod is frictionally held by both the first roller at the groove and by the projection of the second roller, and extruding the grasped rod through a die to form wire by applying an axial force to the held rod by the rollers. The axial, friction motivated force produces a bulge and creates a lateral force which increases as the die is approached. At the die, the lateral pressure is high enough to affect the extrusion through the die to form wire therefrom.

In yet another embodiment, an incoming rod can be formed into wire by grasping the incoming rod at three contact points thereof, namely at two opposed sides and a bottom in a concave hold, rotating the held rod about a first axis, rotatably applying a projection against a top surface of the incoming rod about a second axis parallel to the first axis, the central axis of the rod when grasped being perpendicular to a plane common to the other axes, whereby the rod is formed into a shape determined by the grasping and projection application, and pushing the formed rod through a fixed die having a diameter less than a thickness of the formed rod so as to form wire.

BRIEF DESCRIPTION OF THE DRAWINGS

Other objects, advantages, and features of this invention will become more apparent from a reading of the following description, when read in conjunction with the accompanying drawings, in which.

DESCRIPTION OF A PREFERRED EMBODIMENT IN GENERAL

Figure 1:
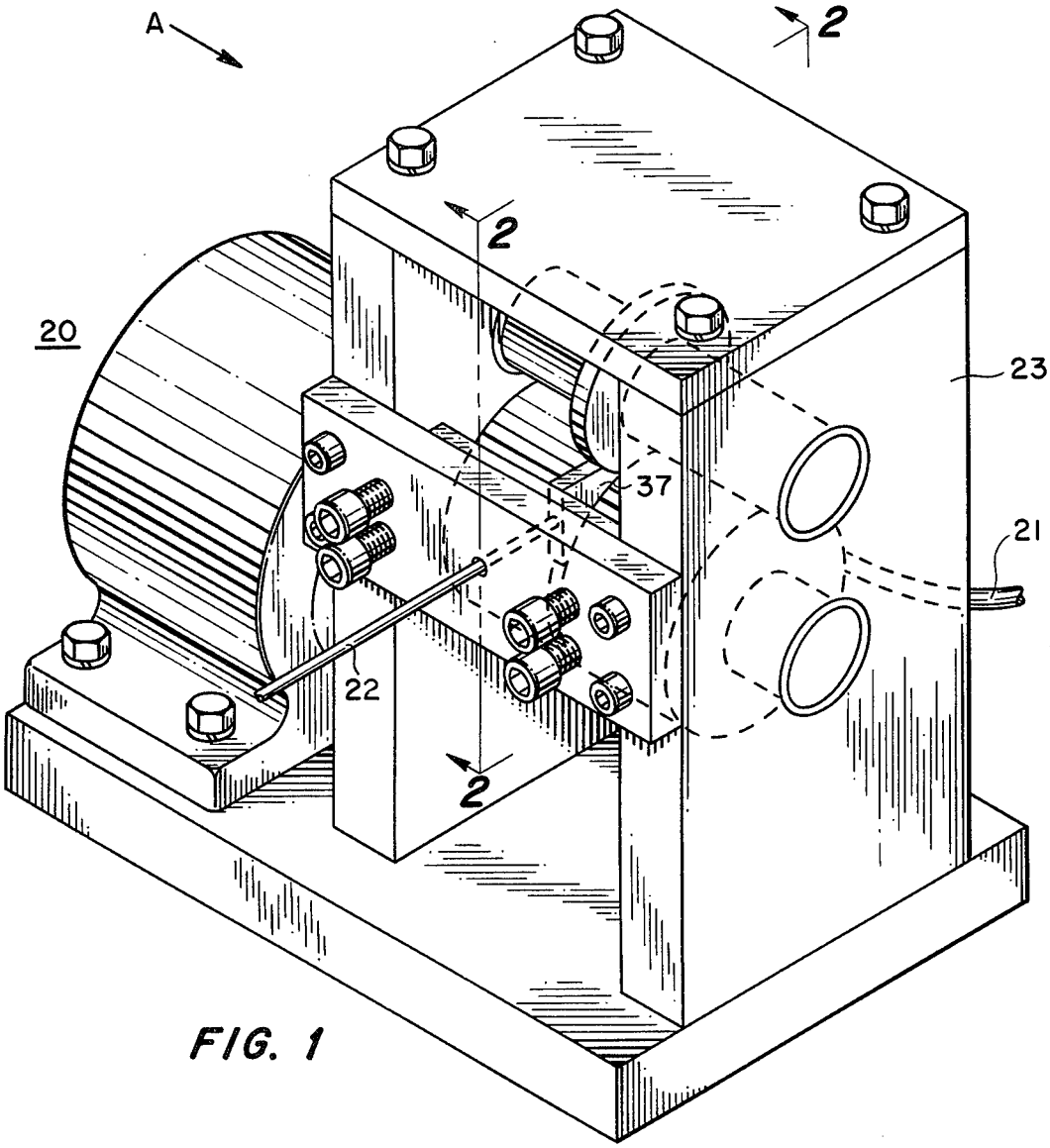
FIG. 1 is a perspective view of one embodiment of the invention.

The invention described herein combines the low friction losses and continuity of a rolling operation with the high reductions possible in extrusion. The deficiencies of rolling and extrusion, namely, small reductions per pass and finite length, respectively, are eliminated. The process materializes by combining the extrusion process with rolling, hence the name 'Extrolling'.

Referring in particular to FIGS. 1 through 4, inclusive, there is depicted apparatus 20 for forming an incoming rod 21 into a wire 22.

The apparatus 20 includes a housing 23 which houses a first roller 24 and a second roller 26.

Figure 2:
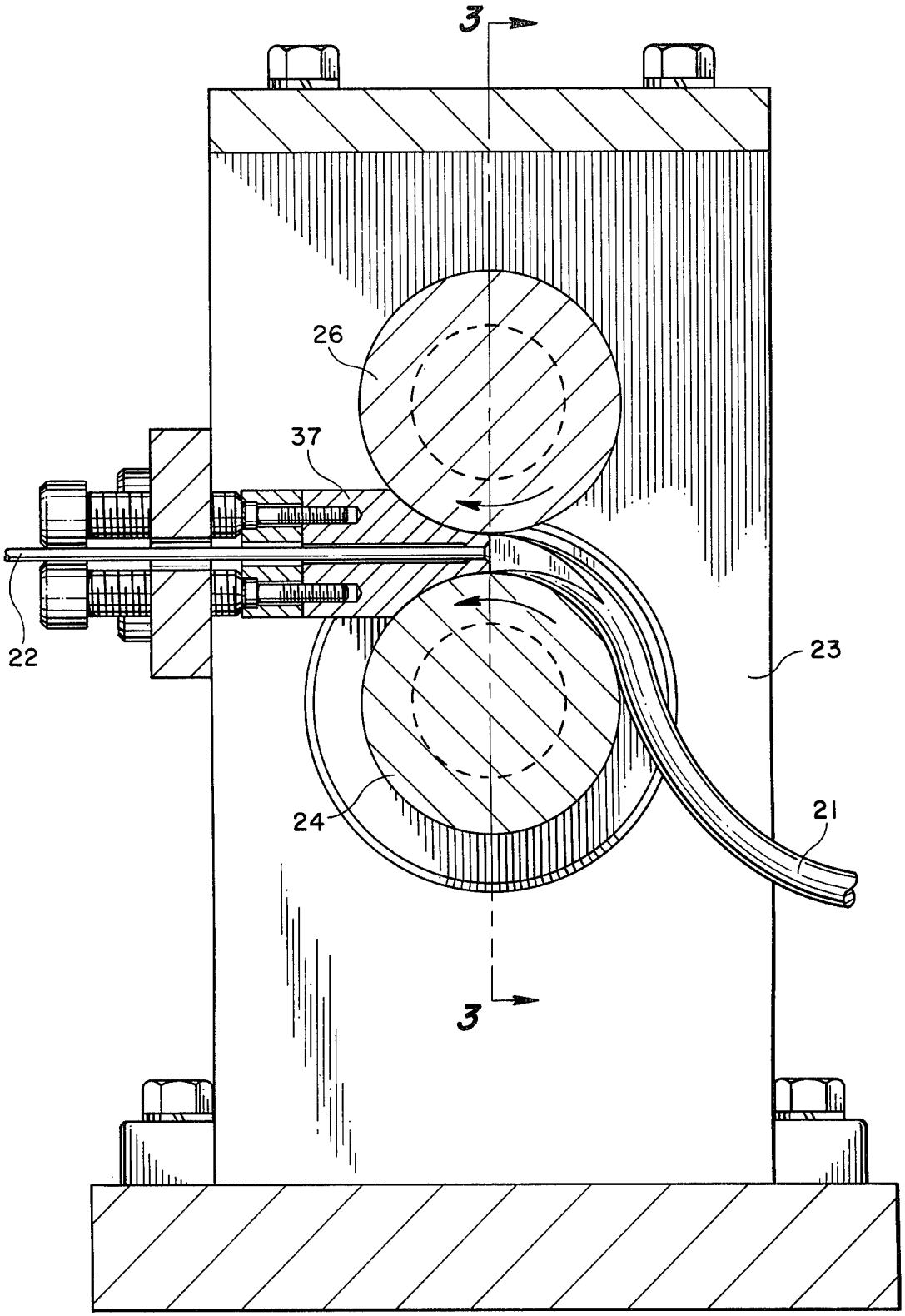
FIG. 2 is a sectional view taken along the lines 2—2 of FIG. 1.
Figure 3:
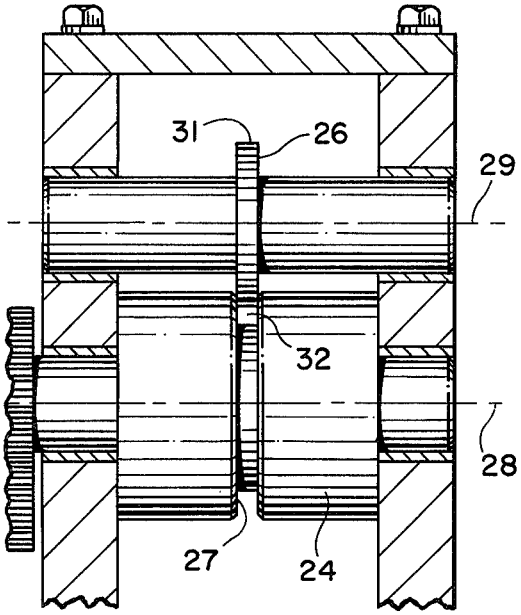
FIG. 3 is a sectional view taken along the lines 3—3 of FIG. 2.

As depicted in FIGS. 2 and 3, the first roller 24 has a circumferential groove 27 having a width somewhat less than that of the incoming rod 21 to be worked upon; thus, the incoming rod 21 can be frictionally held by the groove 27 of the first roller 24. The roller 24 is rotatable about a first axis 28.

The second roller 26 is rotatable about a second axis 29 which is parallel to the first axis 28. The second roller 26 has a circumferential projection 31 thereon. The two rollers 24, 26, are so oriented that the projection 31 and the groove 27, when in co-operating relationship, form an opening 32 therebetween. The opening 32, at a plane common to the axes 28 and 29, has a cross-sectional area less that, equal to, or larger than that of the cross-sectional area of the incoming rod 21 to be worked upon, so that the incoming rod 21, when forced within the opening 32, becomes upset.

The two, almost standard shape rollers 24, 26, with an almost standard rolling mill, provide the always forward moving chamber. While the round rod 21 enters the groove 27, it is being dragged forward by friction.

Figure 4:
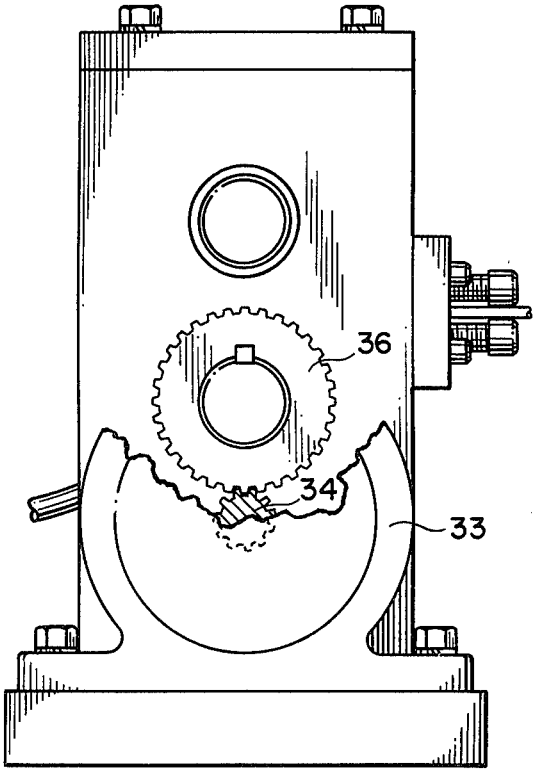
FIG. 4 is an elevational view, partly in section, taken along the line A of FIG. 1.

The first roller 24 can be positively rotated by suitable means, such as a motor 33 whose axial gear 34 drives a gear 36 of the first roller 24, as shown in FIG. 4. In the embodiment shown, the roller 26 is idled and is not positively driven by the motor 33. Referring to FIGS. 1 and 2, there is shown a die 37 which is fixed in location with respect to the two rollers 24 and 26, so that the unsetted rod, when fed between the two rollers 24, 26, is extruded through the die 37 to form wire 22 therefrom.

For the purpose of clarity in the drawings, the sizes of the workpiece and die 37 are exaggerated in comparison to roller diameter. For simplicity of illustration and for convenience of description, incidental details, such as an on-off switch, power-couplings, and the like, are not shown nor described, it being understood that such would be obvious to anyone ordinarily skilled in this art. In substance, as shown in the embodiment illustrated in FIGS. 1 through 4 inclusive, an incoming rod of material 21, such as lead, copper, or other suitable metallic material, is utilized. This rod conventionally is of cylindrical shape, but, however, can take other forms such as rectangular or oval in cross-section. The rod is grasped by the groove 27 of the first roller 24 and is rotated by the roller 24, the roller 24 being positively driven by the motor 33. The rod 21 is deformed within the groove 27 due to the projection 31 of the second roller 26 which is impressed against the rod 21. The roller 26 is free to rotate about the axis 29. The incoming rod 21 becomes upset and generally forms a rectangular cross-section, as depicted somewhat in FIG. 2. The rod is grasped about the bottom and side surfaces thereof by the groove 27 of the first roller 24 and by the top surface thereof by the projection 31 of the roller 26. Since all sides of the incoming rod 21 are being pushed by either the grooved surface 27 of the roller 24 or the projection 31 of the roller 26, the rod 21, in its upset condition, is forced through the die 37, as shown in FIG. 2, to form wire 22 therefrom.

The width of the groove 27 (and each side of the square 32 formed between the groove 27 and the protrusion 31) is about 10% smaller, as an example, than the diameter of the incoming rod 21. With a reduced cross-section, a 10% difference might not be needed. A slight chamfer, of say 15°, at the top of the groove 27 aids the insertion of the larger diameter rod 21 into the groove 27. The protrusion 31 from the opposing roller 26 starts to squeeze and a change in shape of the rod 21 takes place so that friction drag becomes more effective.

It should be noted already, as will be shown later in more detail, that friction drag forward starts in the groove 27 even before the incoming rod 21 is contacted by the protrusion 31, and so does the change in shape of the wire. As the rod 21 reaches the die 37, obstructing the exit, the pressure produced is high enough to cause extension through the die opening. Note that the existence of the die as an obstacle produces a lateral pressure in the groove which enhances the friction drag. Nevertheless, a certain minimum length of contact between the workpiece and the rollers 24, 26, should be maintained. The larger the roller diameter and size reduction through the rollers, the better the drag provided.

DESCRIPTION OF AN ALTERNATE EMBODIMENT

Figure 6:
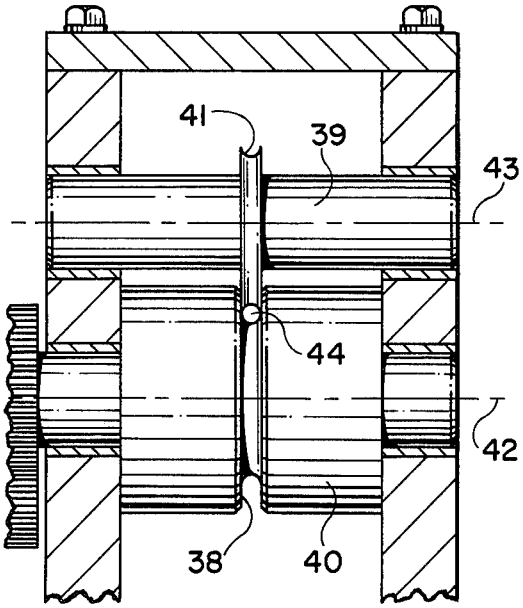
FIG. 6 is a view similar to FIG. 3, taken along the lines 3—3 of FIG. 2, illustrating another embodiment of the invention.

Referring in particular to FIGS. 1, 2, 4, and 6, there is shown an alternate embodiment, somewhat similar to the embodiment described above in connection with FIGS. 1 through 4 inclusive. However, in this embodiment, FIG. 6 is utilized in lieu of FIG. 3. As illustrated in FIG. 6, the apparatus includes a first roller 40 having a U-shaped groove 38 therewithin and a second roller 39 having an inverted concave projection 41 protruding therefrom. As shown in FIG. 6, the projection 41 of the second roller 39 cooperates with the groove 38 of the first roller 40, so that, at a plane common to the axis 42 of the roller 40 and the axis 43 of the roller 39, the projection 41 and the groove 38 form a circular opening 44 therewithin. The circular opening 44 has a cross-sectional area less than that of the incoming rod 21 to be worked upon. In a similar fashion as described in connection with the foregoing embodiment, the incoming rod 21, when forced between the two rollers 40 and 39, undergoes an upsetting character, the rod 21 being forced in a forward direction due to the grooved surface 38 of the first roller 40 and due to the projection 41 of the second roller 39. The rod 21, hence, is pushed through the die 37 and extruded therefrom, as heretofore.

In both this and the foregoing embodiments, both rollers rotate at the same linear speed since the second roller is free to idle.

DESCRIPTION OF ANOTHER EMBODIMENT

Figure 5:
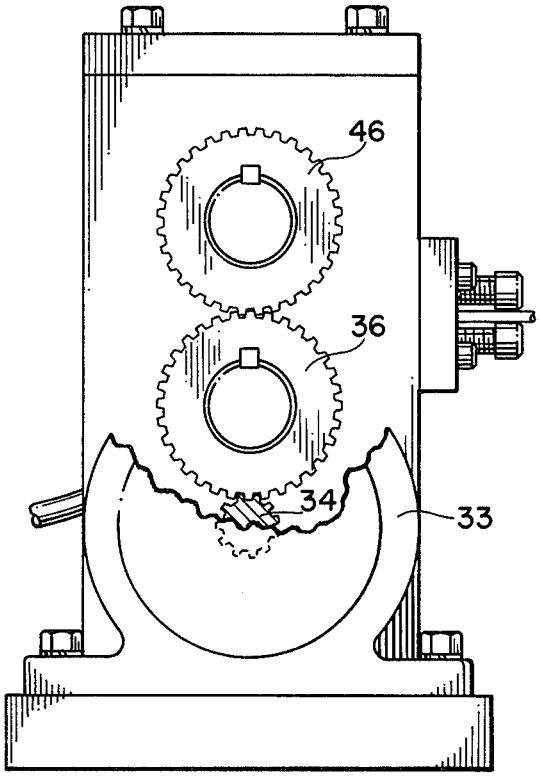
FIG. 5 is a view similar to FIG. 4, taken along the line A of FIG. 1, but showing a different embodiment of the invention.

Referring to FIG. 5, the second roller, whether it be the roller 26 as depicted in FIG. 3 or the roller 39 as depicted in FIG. 6, is positively driven by a gear 46, which gear 46 is driven by the gear 36, which is in turn coupled to the axial gear 34 of a motor 33. Thus, as depicted in FIG. 5, both the first roller and the second roller are positively driven by the motor 33. Both the rollers 24, 26 of the embodiment shwon in FIG. 3, and the rollers 40, 39 of the embodiment shown in FIG. 6, are positively driven by the motor 33 in such a fashion that the external surface of the rollers, that is, the projection 31 of the roller 26 and a grooved portion 27 of the roller 24 (and, likewise, the projection 41 of the roller 39 and the groove 38 of the roller 40) rotate at the same linear speed. Hence, the incoming rod 21, when fed within the openings 32 or 44, is grasped about its periphery and pushed forward through the die 37, the pushing being applied to all the surfaces of the incoming rod 21 being uniform, that is, the tangential speed of the roller at the bottom portion of the rod 21 is identical to the tangential speed at the top surface of a rod 21.

THE ROLLERS

Two powered rollers, in the embodiment of FIG. 5, one rotating clockwise while the other rotates counterclockwise, drag the rod 21 by frictional means into the narrowing gap between the rollers. Note that the same concept works also when one roller is powered and the other is idling, as in the embodiment of FIG. 4. While one roller 24 contains a groove 27, the other 26 contains a matching protruding cylindrical ring 31 that enters the groove 27 to close it from above (see FIG. 3). Between the groove 27 and the protrusion 31, the gap is providing an open-ended chamber 32. Three walls of the chamber 32 are provided by the groove 31 and the fourth wall is provided by the outer surface of the protrusion (see FIG. 3). The incoming circular rod (workpiece) 21 contacts the walls of the chamber 32 initially at the entrance only along four limited points of contact. But progressing towards the die block and encountering resistance to the forward motion, the rod is upset. The area of contact increases and drag becomes more effective. This is also due to increased pressure between the upset rod and the walls of the chamber. Approaching the die 37, the rod may completely conform to the shape of the groove, or the corners may remain rounded to varying degrees. At the die block, the friction drag is providing enough pressure to cause the rod to extrude through the die opening. The die block fits into the groove and the protrusion to provide a closure for the exit side of the extrusion chamber (FIG. 2). Clearance between the die block and the groove and protrusion is minimal. The front face of the die block is at the place connecting the axis of symmetry of the two rollers.

The groove may be rectangular (FIG. 3) or it may have a shaped bottom or a rounded bottom (FIG. 6). The die block is shaped accordingly. The outer surface of the protrusion can also be shaped.

Today, the most popular shape of raw material as a workpiece is a round rod, probably produced by rolling. Hence, the basics of the concept, conventionally, are introduced through the use of an original round workpiece. However, better economy and less redundant work can be achieved if one starts with a rod of square cross-section with a square groove and chamber. This square rod can easily be produced if one considers combining continuous casting as the first process preceding the Extrolling operation.

DESCRIPTION OF ANOTHER EMBODIMENT OF THE INVENTION

Figure 7:
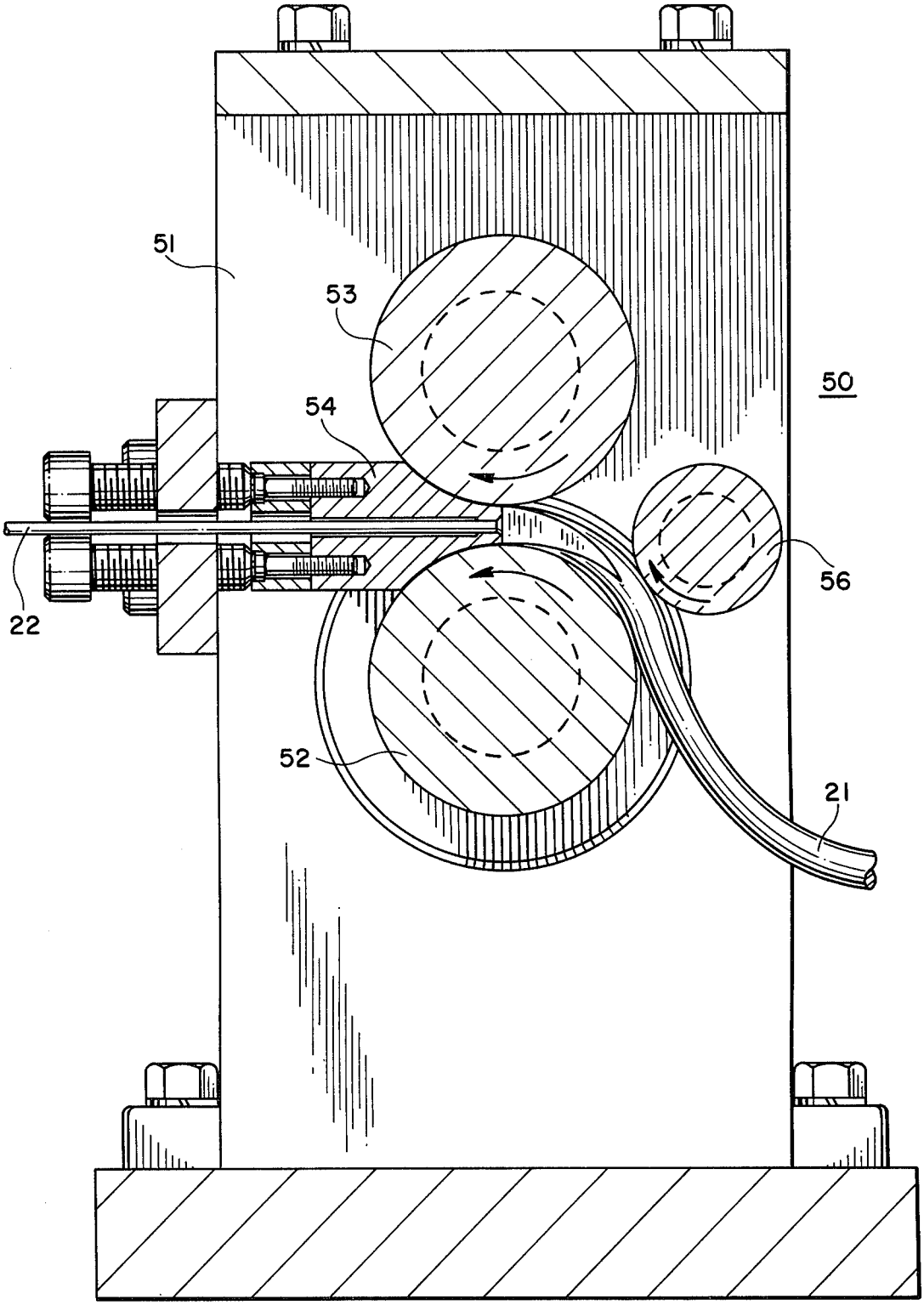
FIG. 7 is a view taken along the lines 2—2 of FIG. 1 of still another embodiment of the invention.
Figure 8:
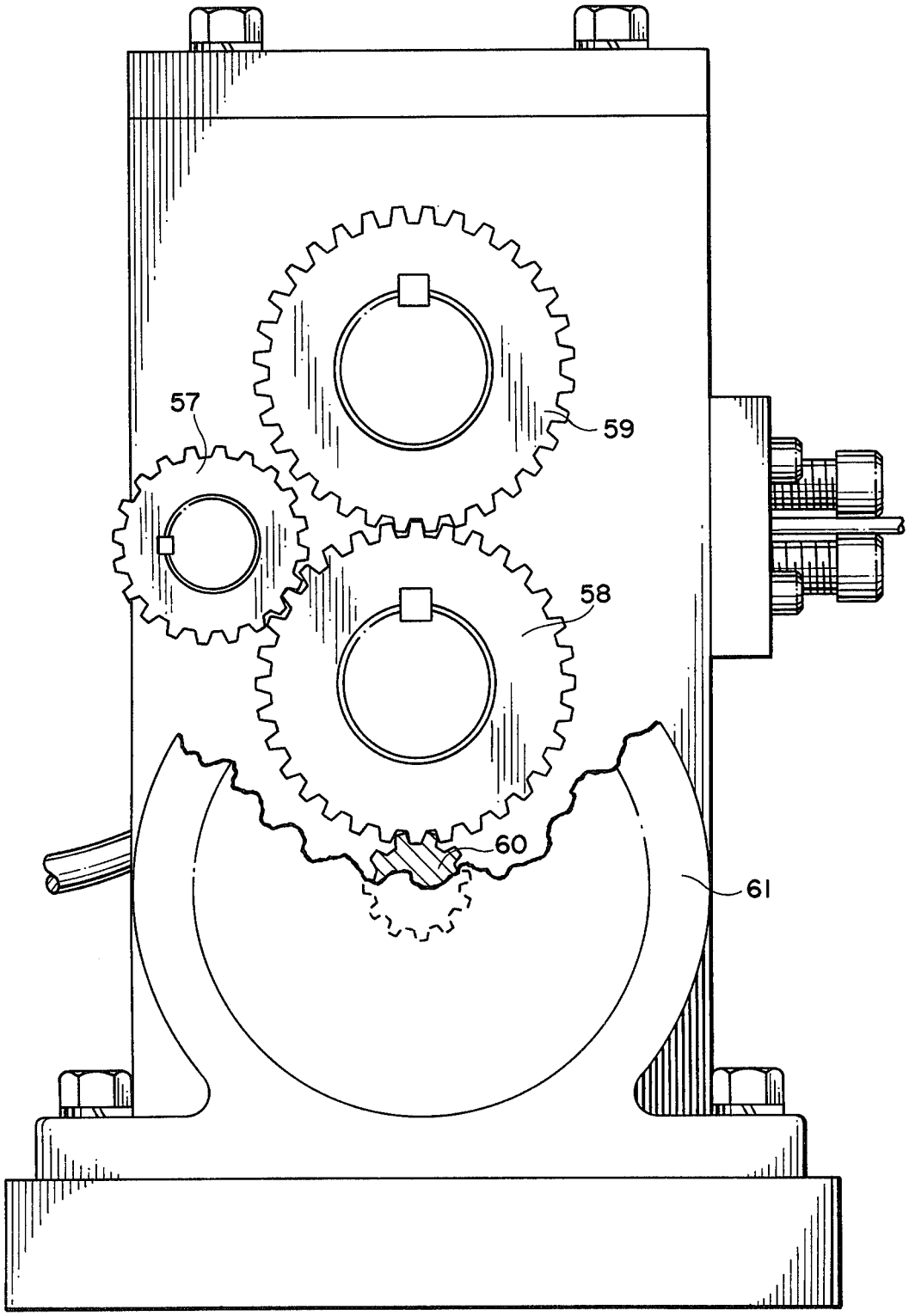
FIG. 8 is a view of the embodiment shown in FIG. 7 taken along the line A of FIG. 1.

Referring to FIGS. 7 and 8, there is shown apparatus 50, including a housing 51, a bottom roller 52, a top roller 53, and a die 54, all of which operate in a manner similar to that described heretofore.

In addition, however, there is shown a third roller 56. The third roller 56 is driven by a gear 57, which gear 57 is driven by a gear 58 affixed to the first roller 52. The gear 58 also drives a gear 59 attached to the second roller 53. The gear 58 is driven by the axial gear 60 of a motor 61. The rollers 52 and 53 are driven so that their circumferential surfaces rotate at the identical linear speed as heretofore described above, but, however, the third roller 56 preferably, is driven at a higher linear speed than that of the two rollers 52 and 53. Alternatively, however, the third roller 56 may be driven at the same speed as the other two rollers 52 and 53, or may be idled.

In operation, an incoming rod 21 is fed into the groove of the first roller 52. The groove of the first roller 52 can take any of various shapes, including U-shape or rectangular-shape, as described in connection with other embodiments. The third roller 56 pushes the incoming rod 21 into the groove of the first roller 52. The incoming rod 21, being frictionally held by the groove of the first roller 52, is rotated and is further grasped by the projection of the roller 53. The circumferential surface of the incoming rod 21 in its upset condition is pushed by the rollers 52 and 53 through the die 54 to form wire 22 therefrom.

THE DIE

Figure 9A:
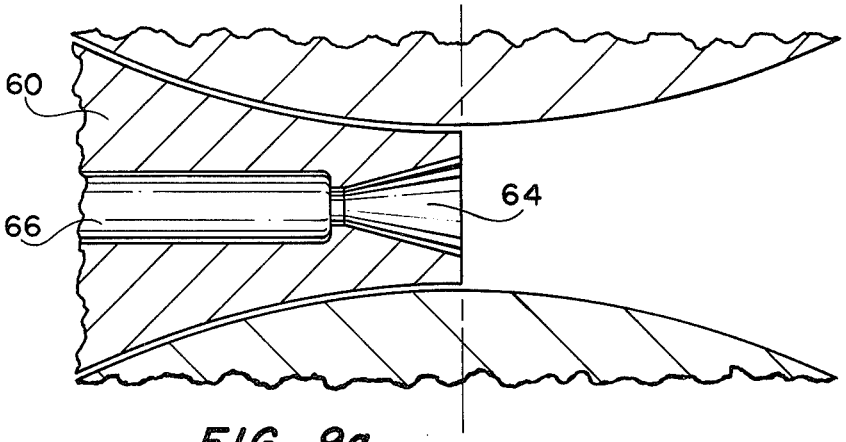
FIGS. 9*a*, 9*b*, and 9*c* are fragmentary sectional views, showing different die configurations in accordance with various embodiments of the invention.
Figure 9B:
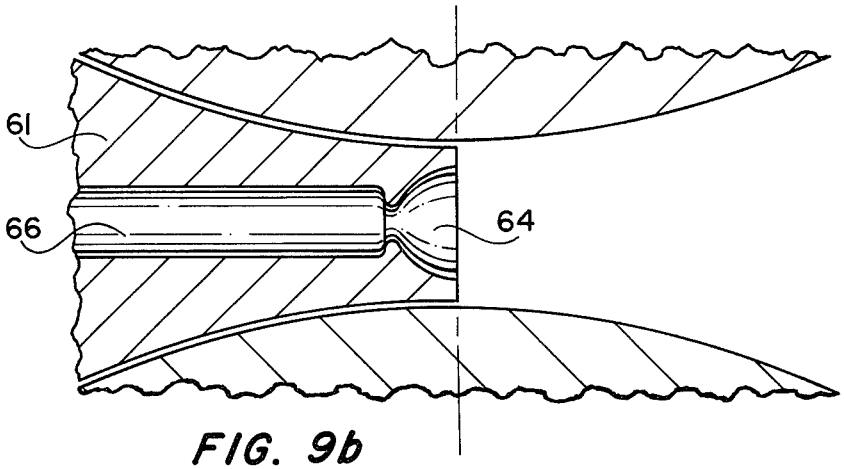
Figure 9C:
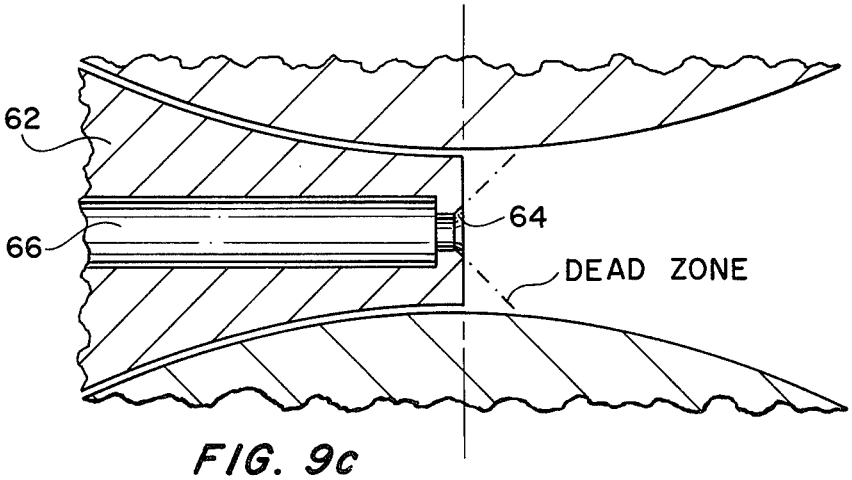

A suitable die 60 is illustrated in FIG. 9*a* having a particular configuration. Similarly, a die 61 and a die 62 is depicted in FIGS. 9*b* and 9*c*, respectively. The die 60, 61, 62, as depicted, have various different shaped entrances 64—64 to the respective orifices 66—66. The dies 60, 61, 62 can be oriented with respect to the two rollers as shown, and, alternatively, can be oriented displaced from the central axis thereof towards the left (not shown). Various alternatives will suggest themselves to those ordinarily skilled in the art.

The entrance to the die may be tapered or rounded, or a square die entrance may be used. Close fit of the die block to the groove and upper roller together with a square die and dead zozne formation may serve to seal the clearance and prevent material from escaping. On the other hand, a liberal clearance and tapered die can produce a scalp removed from the surface and discarded. Thus, the poor quality of the surface is shaved off and the wire produced does not contain residual surface defects.

A variety of shapes can be produced. Even several rods can be extrolled from a single original rod if the die block contains several die holes. By introducing several holes, the total reduction is reduced together with the required pressure, while a small size product is produced from the heavy gauge rod.

One disadvantage of the use of the concept of using several holes during conventional extrusion is the shorter individual rods. During a continuous process with this invention, however, each individual rod is still continuous and of unlimited length. The amount of work reduces and processing efficiency increases drastically as the total cross-section area of the individual rods increases.

ENHANCEMENT OF GRIP

This process depends for its success on utilization of friction between the rollers and the workpiece. It may be classified as a friction-aided process. The confines of the open ended chamber serves to exert wall pressure on the upset workpiece and thus enhance the friction drug. Means to affect increase in the grip are:

1. Larger ratio Larger ratio of roller diameter to the cross-section size of the workpiece.
2. Higher Friction Higher values of friction namely, rougher rollers and less lubrication.
3. Higher degree of change Higher degree of change in size and shape of the workpiece during the upsetting. Some freedom in adjustments of the height of the gap by screw-down of the rollers can be exercised.
4. Change in position of the die block One can position the die block at varying distances to the exit side from the line connecting the center lines of the rollers. Thus, the wire has longer contact with the rolls. The amount of expansion of the cavity is slight when the distance is short. The cavity is filled with the rod due to upsetting. The die can be placed even on the entrance side from the line connecting the center lines of the rollers.
5. Forward push By wrapping the incoming wire around part of the roller with the groove, contact is lengthened. Further enhancement of grip can be achieved by an additional roller (FIGS. 7 and 8) that can be powered to rotate at a circumferential velocity faster than that of the two rolls. The speed differential can be varied. The additional push by the roller helps upsetting and enhancing the firction grip. Friction grip can also be enhanced by a guard with conjunction with and/or without the auxiliary roller.

Workable Materials

Most materials that can be either rolled or extruded can also be extrolled. The process can also be adopted to processing at elevated temperatures.

As an ultimate goal, one can envision the use of the process where the starting material is a powder being compacted during extrolling. Even the production of fibrous and clad materials can be forseen. Continuous fibers can be fed through the powder so that the product will be a compacted matrix with fibers inside. As a consequence, it is desired that this invention be broadly construed to include such forseen materials.

ALTERNATE DESIGNS

Forward

In the foregoing sections, a new concept of friction motivated open ended extrusion chamber with continuous forward motion was introduced, termed "Extrolling". A square channel confined between the groove and a protrusion in the roller was employed. (Modified shapes were also introduced). Some shortcomings of this design may tend to limit the permissible pressure within this chamber since the edges and corners of the groove and the features of the protrusion are the weak links of this design. However, some modifications, within the scope of this invention, to provide a groove by assembling the components of the roller will suggest themselves to those skilled in the art. For example, the protrusion can be made as a separate part; if it falls it can be replaced without discarding the roller. Sleeves and protrusion can also be made from better, more expensive, material than the roller. A locking key and clamping sleeves can transfer the rotary motion and clamp the sleeves in the proper axial tight position, respectively. Such modifications, within the scope of this invention, are readily apparent to those skilled in the art. One design utilizing the same general concept, but with specific advantages in some ares, is presented next as a process called: "Extrolling Lined Up Multirods Product"

Extrolling Lined up Multirods Product

The Concept

The possibility of producing several rods from one incoming rod was mentioned hereinabove. The advantage of continuity is still maintained while much lower pressures are needed. There, the groove and incoming rods were of about equal width to height dimensions. With such a groove, the lateral pressure on the side walls of the groove is considerable. When several wires or a strip are rolled, the lateral axial pressure reduces. Theoretically, when width to thickness becomes infinity, the lateral force reduces to zero. Furthermore, when the radius of the rollers is much larger than the gap between the rollers, as large a reduction in area as desired, between raw material and the product can be achieved.

Figure 10:
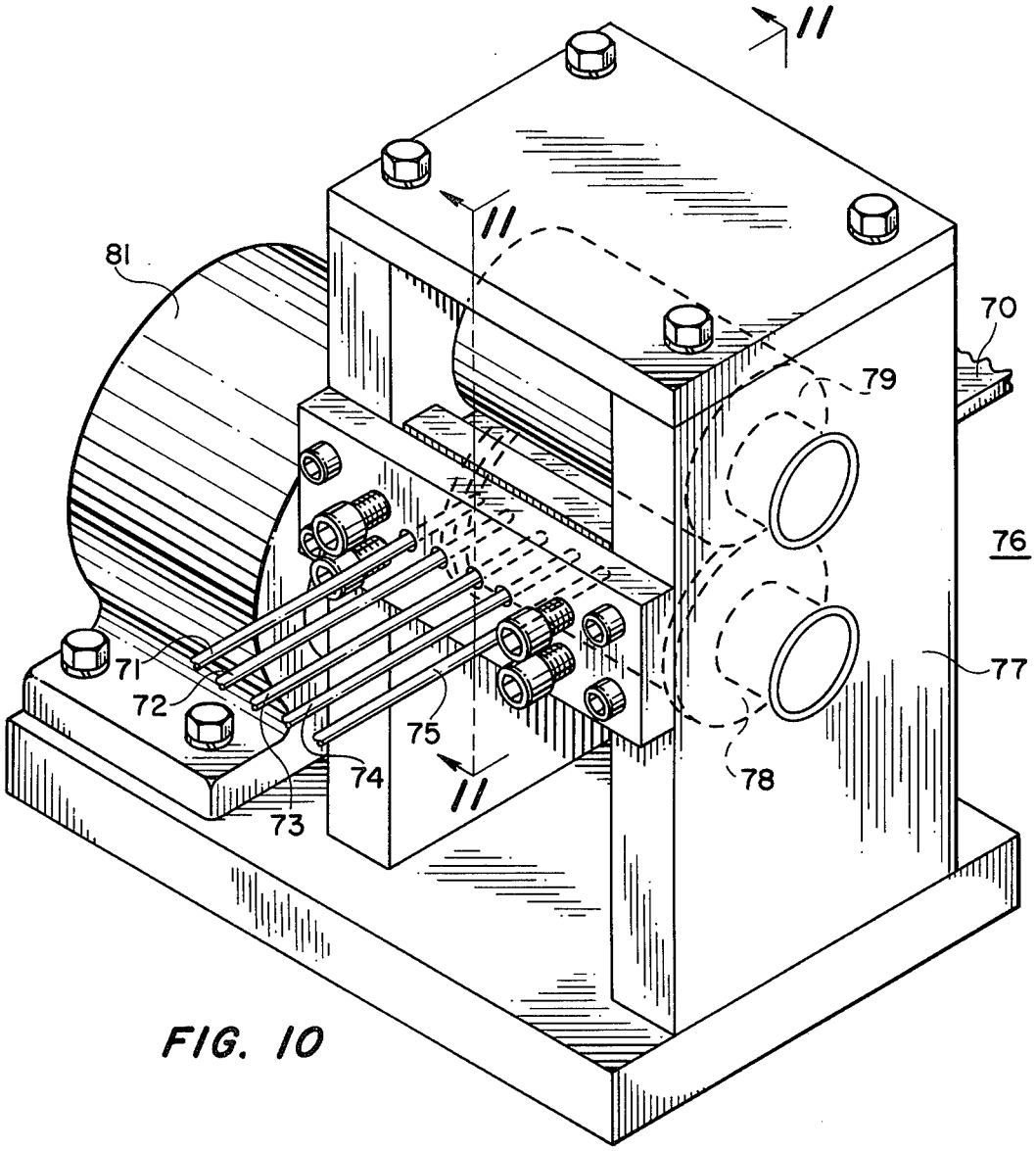
FIG. 10 is a perspective view of yet another embodiment of this invention illustrating a multi-wireforming apparatus.
Figure 11:
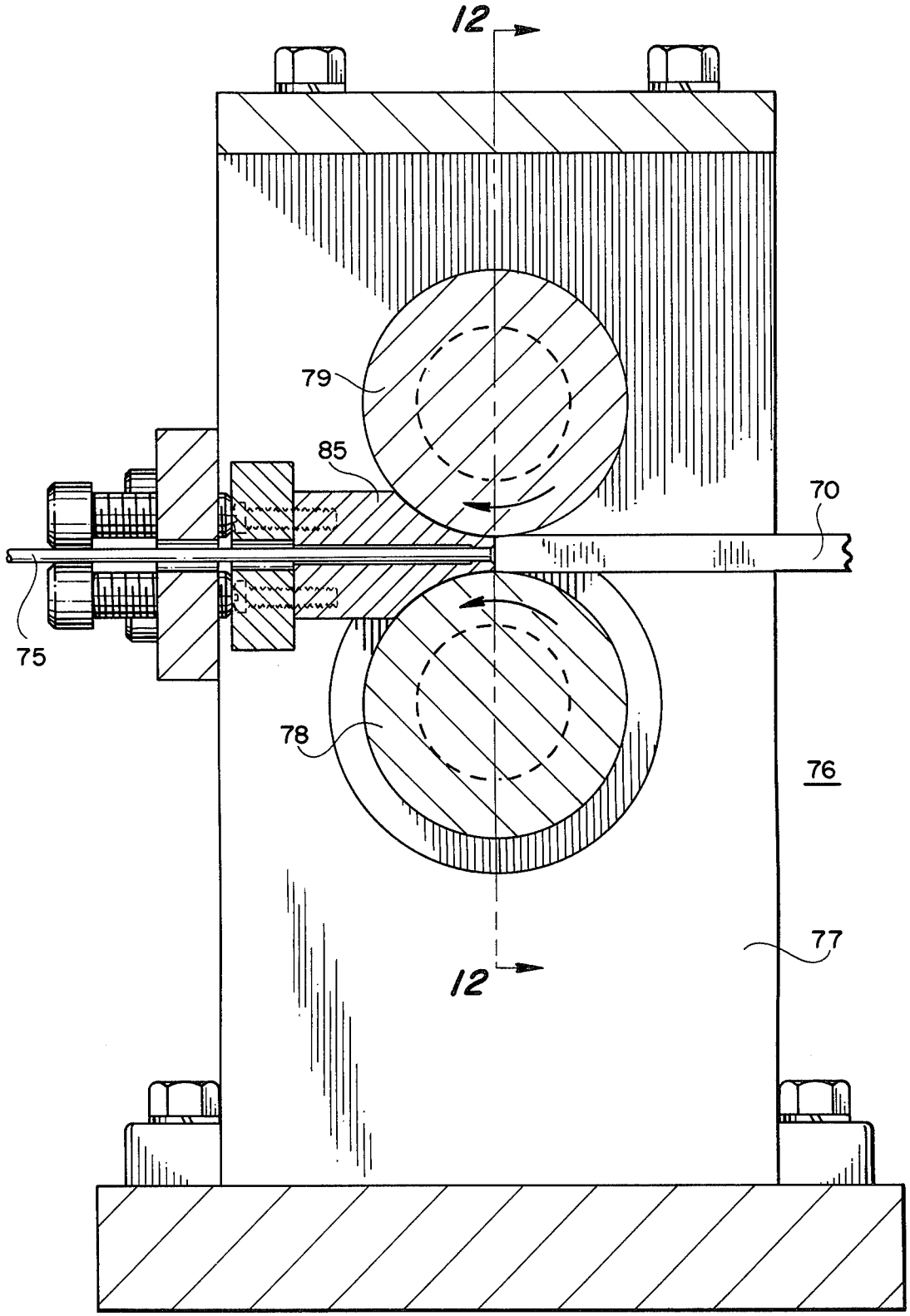
FIG. 11 is a sectional view taken along the lines 11—11 of FIG. 10.
Figure 12:
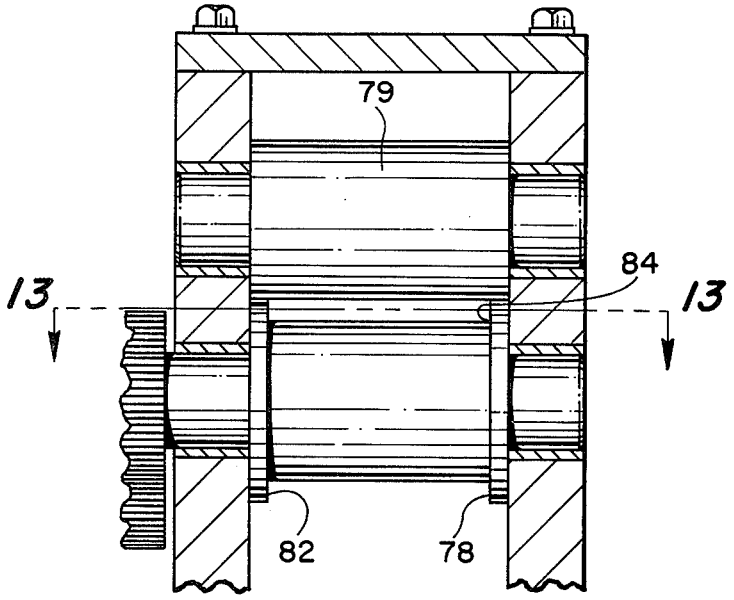
FIG. 12 is a cross-sectional view taken along the lines 12—12 of FIG. 11.
Figure 13:
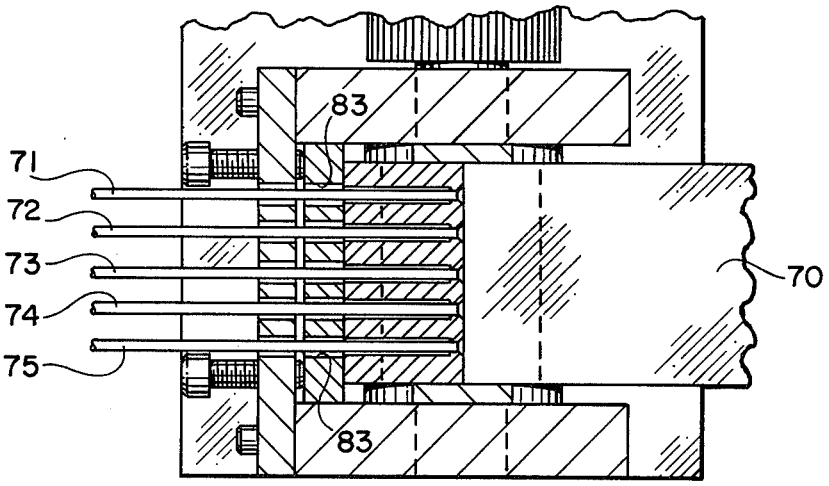
FIG. 13 is a cross-sectional plan view taken along the lines 13—13 of FIG. 12.

FIGS. 10 through 13, inclusive, depict a varation of applicant's invention, wherein an incoming sheet 70 of material is converted into a plurality of formed wires 71, 72, 72, 74, 75. Apparatus 76 for so converting the sheet of material 70 into a plurality of wires 70–75 includes a housing 77, a first roller 78, and a second roller 79, as depicted in FIGS. 10 and 11. The first roller 78 is positively driven by a motor 81, whereas the second roller 79 can be either positively driven by the motor 81 or permitted to be idled, whichever is preferred by the user. The first roller 78, as depicted in FIG. 12, includes a groove 82 therewithin for accepting the incoming sheet 70 of material. The second roller 79 operates with respect to the incoming sheet 70 to upset the sheet within the recessed opening 84 formed by the roller 79 and the groove 82 of the roller 78.

The upsetted sheet 70 is forced forward, about the bottom, by the groove 82 of the roller 78, and about the top by the roller 79, and forced through a plurality of orifices of a die 85 to form the wire 71–75 therefrom.

In essence, the operation is similar to the principles described above. Namely, a sheet of material is upsetted and formed into a plurality of wire. This can be achieved simply as described here. In addition, the upper roller 79 may be positively driven, and alternatively, a third roller may be provided to further aid in forcing the sheet 70 into the first roller 78.

In FIGS. 10–13, strip rolling to produce multiware is shown. The strip can be replaced by a row of wires (round or square) constraining each other. The side guard of the groove can be:

1. Part of the rollers,
2. A stationary side guard, or
3. Eliminated altogether when a strip is the raw material.

Side pressure for multiware rolling is negligible. There is no need for a protrusion on the opposite roll in this design, so one roller can be cylindrical.

The Raw Material

The raw material, as already suggested, can be a strip. In thin strip rolling, there is no limit to the reduction possible, as long as the rollers and mill can withstand the required pressures. Thus, a wide channel, open at the entrance, is constructed with as much pressure as needed produced at the die. The raw material can be a row of rods, constrained by the rollers on top and bottom, from the side, each rod is constrained by the neighboring rods, while the two extreme rods are constrained by the sides of the step in one of the rollers or by a side guard.

When multirod is used as the raw material, the incoming individual rods may be of the conventional round cross-section. The upsetting into squares occurs as described in the single rod arrangement in a square groove. On the other hand, square rods can serve as the original raw material.

When round rods are used, the advantages are;

1. The raw material is of a more readily available shape
2. Minimum prealignment of the individual rods is required.

The disadvantage is that some redundant work is wasted on the upsetting of the rods prior to their entrance to the die (and larger reduction).

A square rod is not so readily available, but can be rolled or even provided directly from a continuous casting process. When square rods are the raw material, precautions should be taken to prevent twisted positioning.

The Die(s)

The wide die permits a variety of design options. The support back portion of the die may have inserts of individual dies of carbide or harder material. Or, simply the front end of the die may be separate from the backing support. The front edge of the die assembly can be adjusted forwards or backwards as can the individual die in the preceding section.

No attempt is made here to describe details of all possible die assembly designs.

Augmentation

One difficulty with multirod extrusion is the uneven flow. Usually it is not to be expected that all outgoing wires (rods) will move freely at the same speed. One can adjust the equipment design and production practice to accommodate the said phenomena. On the other hand, augmented pull can be adopted to force all emerging individual rods to exit at identical speeds.

ALTERNATIVE EMBODIMENT

Earlier, in this specification, at Background of the Invention, 2. Description of the Prior Art, reference was made, under d. Continuous Extrusion Forming to work done by D. Green using a stationary semi-circular member, and a rotating cylindrical tool. That concept is best shown by FIG. 3, pages 295–300 of Journal of the Institute of Metals, 1972, Vol. 100. In this latter concept, Green's stationary semi-circular member, or "shoe", is cylindrical and having a concentric axis of symmetry with the rotating shaft for the rotating cylindrical tool. Thus, the cross-section of the chamber formed by Green's tool and shoe is constant. In operation, the worked rod bulges to conform to the chamber cavity.

Figure 14A:
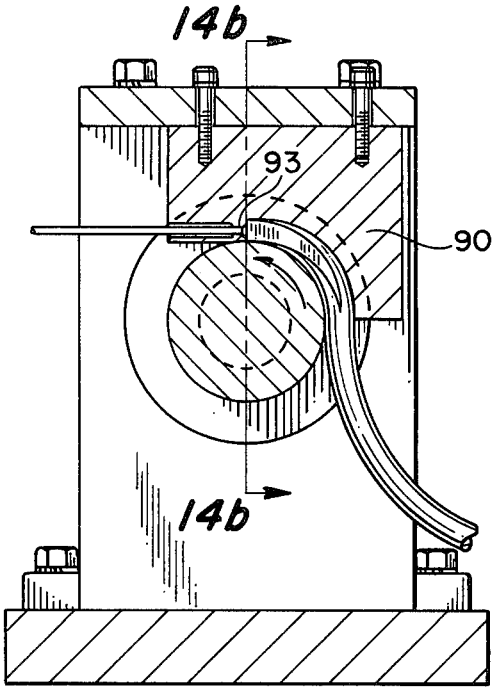
FIGS. 14*a* and 14*b* are views of another embodiment of this invention.
Figure 14B:
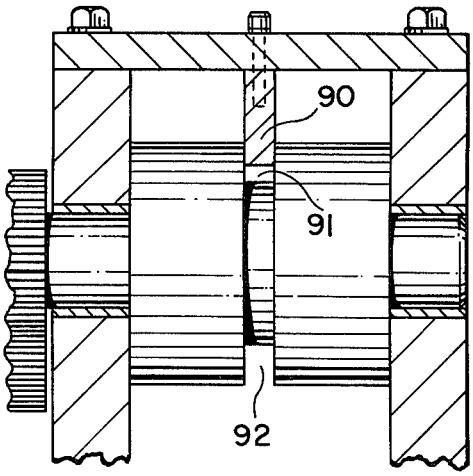

In a modification of Green's concept, by the applicant hereof, significant improvement is possible, as depicted in FIGS. 14*a* and 14*b*, by providing a shoe 90, eccentrically oriented in a spiral configuration, so that the gap 91 formed by the rectangular groove 92 and the shoe 90 gradually reduces as the die 93 is approached.

Advantageously, the gradually narrowing gap 91 exerts pressure more effectively and through shorter contact lengths than in Green's embodiment. Furthermore, efficency of power can be optimized with the spiralling configuration.

SUMMARY

In these processes, initially, slight drag builds up by a chain reaction of higher pressure causing more upsetting, causing higher friction drag, which leads to higher pressures. The blocking at the exit and initial minimal contact are essential. The initial slight contact can be achieved through differential size between raw material and chamber. For example, smaller size groove or smaller gap between rolls than size of incoming raw material.

Another means to initiate contact at the entrance can be an extra provision to push the raw material into the chamber.

In the preferred mode, an incoming rod is formed into wire by initially grasping the incoming rod about various contact points thereof, namely, at the bottom and sides by a groove shaped member, the groove shaped member being rotated. A protrusion shaped member is applied into mating contact with the incoming rod at the top surface thereof, so as to upset the incoming rod into a shape defined by the protrusion and by the groove. The protrusion shaped member is rotated at the same linear speed as the groove shaped member so as to frictionally push the upsetted rod through a die which has a diameter less than the external dimensions of the incoming rod so as to extrude wire therefrom.

Essentially, a wire is formed by a combined process of rolling and extrusion, which the inventor hereof has termed "Extrolling " that is extrusion and rolling.

Insofar as the scope of the claims are concerned, it is desired that they be broadly construed to include single rod, plural rods, and strip or sheet material, whether of circular or rectangular configuration. The term "die" is intended to include such devices as contain a plurality of orifices for simultaneously producing a plurality of wire strands, in addition to the usual die containing but one orifice.

I claim:

1. Apparatus for forming wire comprising:

a. first roller means having a circumferential groove with a width somewhat less than that of an incoming rod to be worked upon, whereby said incoming rod can be frictionally held by said groove of said first roller means, said first roller means being rotatable about a first axis;

b. second roller means rotatable about a second axis, said second axis being parallel to said first axis, said second roller means having a circumferential projection thereon, said first and said second roller means being so oriented so that said projection and said groove, when in cooperating relationship, form an opening therebetween, said opening at a plane common to said first and said second axes having a cross-sectional area less than that of the cross-sectional area of said incoming rod to be worked upon whereby said incoming rod when forced within said opening becomes upset;

c. means for rotating said first roller means;

d. a die located in a zone with respect to both said roller means so that said upsetted rod may be fed by said roller means with sufficient force to extrude said rod through said die to form wire therefrom, e. one extremity of said zone being a plane passing through the axes of rotation of said roller means, the other extremity of said zone being defined by a distance corresponding generally to the radius of one of said roller means, and f. said die having an orifice whose axis is generally perpendicular to said plane.

2. The apparatus as recited in claim 1 further comprising means for rotating said second roller means at the same linear velocity as that of said first roller means.

3. The apparatus as recited in claim 1 further comprising:

e. third roller means having an axis parallel to said first and second axes, said third roller means being oriented with respect to said first roller means so as to initially engage said incoming rod and to force at least a portion of said rod into said groove of said first roller means prior to said incoming rod coming into contact with said projection of said second roller means.

4. The apparatus as recited in the claim 3 further comprising:

f. means for rotating said third roller means at a linear velocity in excess of that of said first roller means.

5. The apparatus as recited in claim 1, wherein said groove of said first roller means has a rectangular configuration.

6. The apparatus as recited in the claim 5, wherein said projection of said second roller means has a rectangular configuration.

7. The apparatus as recited in claim 1, wherein said groove of said first roller means has a U-shaped configuration.

8. The apparatus as recited in claim 7, wherein said projection of said second roller means has a concave configuration.

9. The apparatus as recited in claim 7, wherein said projection of said second roller means has a rectangular configuration.

10. Apparatus for forming an incoming metal rod into a wire comprising:

a. means for grasping said incoming rod at three contact points thereof, namely at two opposed sides and a bottom, in a concave hold;

b. means for rotating said grasped rod about a first axis transverse with respect to the longitudinal axis of the rod;

c. means for rotatably applying a projection against a top surface of said grasped rod, about a second axis parallel to said first axis, the central axis of said rod at a point where grasped being perpendicular to a plane common to said first and said second axes, whereby said rod is upsetted into a shape determined by said grasping means and said projection application means;

d. a fixed die having an orifice whose axis is generally perpendicular to and adjacent said plane, said orifice having a diameter less than a thickness of said upsetted rod; and e. means including said rotatable grasping means and said rotatable projection application means for pushing said upsetted rod through said fixed die so as to extrude a wire of small diameter.

11. Apparatus for forming wire comprising:

a. Means for passing an incoming rod of material having a first cross-sectional area through a pair of opposed members which rotate about parallel axes, wherein said opposed rotating members have external cylindrical surfaces which cooperate so as to form a second cross-sectional area in the plane common to said axes, said second cross-sectional area being less than that of said first cross-sectional area so that said rotating members upset said incoming rod in a rolling manner; and b. A die adjacent said plane and having an orifice aligned with said second cross-sectional area; said die orifice blocking discharge from said second cross-sectional area so that the rod moves directly into said die orifice, said die orifice being spaced from said plane by a distance substantially less than the radius of said members; said members having sufficient frictional contact with said rod so that said rod may be extruded through the die orifice to form wire.

12. Apparatus for forming wire comprising:

a. first rotatable means, having a groove thereon with a dimension less than that of an incoming rod to be grasped, so that in incoming rod, upon being initially held against said groove, is deformed to fit into said groove;

b. second rotatable means, adapted to have a linear circumferential speed equal to that of said first rotatable means, for forcing said incoming rod further into said groove;

c. a die tangentially arranged with respect to said groove and having at least a portion thereof in said groove, and d. means including said first and second means for extruding said deformed rod through said die to form wire therefrom.

13. Apparatus for forming wire comprising:

a. first rotatable member for grasping an incoming rod of material, said member including a circumferential groove having a dimension less than those of said incoming rod so as to frictionally hold said rod;

b. a second rotatable member having an exterior circumferential surface positioned to cooperate with said groove so that at least a portion of said incoming rod is held about its entire periphery;

c. a die having an orifice aligned tangentially with a portion of said groove located opposite said second member; and d. motor means for rotating said members at the same speed so as to force the rod into and extrude said rod through said die.

14. Apparatus for forming wire comprising:

a. first circumferential member means for grasping an incoming rod of material, said means including a groove having a dimension less than those of an incoming rod so as to frictionally hold said rod;

b. a second circumferential member means adapted to be rotated about its axis having an exterior circumferential surface adapted to cooperate with said grasping means, so that at least a portion of said incoming rod is held about its entire periphery;

c. a die;

d. means for rotating said grasping means so as to extrude said held rod through said die;

e. third circumferential member means for urging said incoming rod against said first circumferential member means prior to said rod coming in contact with said second circumferential member means; and f. means for rotating said third circumferential member means at a linear circumferential velocity greater than that of said first circumferential member means.

15. Apparatus for forming wire comprising:

a. means for feeding an incoming rod of material having a fixed diameter into a circumferential groove of a first circular roller, wherein the width of said groove is less than the diameter of said incoming rod;

b. means for deforming said incoming rod by forcing said incoming rod into said groove so that said incoming rod is frictionally held by said roller;

c. a second roller for upsetting said held incoming rod by a projection on said second roller which engages with an opposed surface of said held incoming rod, so that said incoming rod is frictionally held by both said first circular roller and by said projection of said second roller; and d. means including said rollers and a die for extruding said rod by applying an axial friction force to said rod by said rollers to produce a bulge and create a lateral force, said lateral force increasing as the die is approached, whereby at said die, the lateral pressure is high enough to affect the extrusion of said rod through the die to form wire therefrom.

16. A method of forming an incoming rod into a wire comprising the steps of:

a. grasping an incoming rod about three contact points thereof, namely at two opposed sides and a bottom, by a groove-shaped member;

b. rotating said groove-shaped member so that the grasped rod lies along a portion of said groove;

c. applying a protrusion-shaped member into mating contact with said incoming rod at the exposed surface thereof, so as to upset said incoming rod into a shape defined by the juxtaposed surfaces of said protrusion and said groove;

d. providing a die having a diameter less than the external dimensions of said incoming rod and positioned at least partially in the groove with its orifice aligned with that portion of the groove juxtaposed to said member, and e. rotating said protrusion-shaped member, at the same linear speed as said groove-shaped member, so as to frictionally push said upsetted rod through said die so as to extrude wire therefrom.

17. A method of producing wire comprising the steps of:

a. grasping an incoming rod of material by a first rotating member having a groove therein, said groove having a dimension less than that of said incoming rod, so that said rod, upon being initially grasped by said groove, is deformed to fit into said groove;

b. applying a force to an external surface of said grasped incoming rod, a radial component of said force forcing said grasped rod further into said groove, said force including a tangential component, said force being provided by a second rotating member having a circumferential speed equal to that of said first rotating member; and c. extruding a plurality of wires by said members which push said rod through a die having a plurality of orifices to form the wires therefrom.

18. A method of forming wire comprising the steps of:

a. grasping an incoming rod of material by a member having a groove therein with a dimension less than that of said incoming rod so that, when grasped, said rod extends along a portion of and becomes deformed within said groove and held thereby;

b. rotating said member so that said held incoming rod comes into contact with an opposed rotating member having a protrusion thereon so as to further force said incoming rod further into said groove, whereby said rod is held frictionally by both said rotating members; and c. extruding said held incoming rod by frictionally pushing said incoming rod about its circumferential surfaces through a die to form wire therefrom.

19. A method of forming wire comprising the steps of:

a. grasping a portion of an incoming rod of material by a circumferential groove of a first rotatable member, said groove having a dimension less than a dimension of said incoming rod so that said incoming rod is frictionally held by said groove of said first member;

b. rotating the held incoming rod portion past a second rotatable member; said second rotatable member having an exterior circumferential surface so as to cooperate with the incoming rod portion, to hold said incoming rod portion within the groove of said first member and so that said incoming rod portion is held about its entire periphery by both said groove of said second member;

c. extruding said incoming rod by pushing said rod through a die to form wire therefrom, d. causing a third rotatable member to urge said incoming rod against said first member, prior to said incoming rod coming into contact with said second member; and e. rotating said third member at a higher circumferential linear speed than said first member.

20. A method of forming an incoming rod into a wire comprising the steps of:

a. grasping said incoming rod at three contact points thereof, namely at two opposed sides and a bottom, in a concave hold of a rotatable member;

b. rotating said held rod about a first axis corresponding to the axis of rotation of said member, c. rotatably applying a projection against a top surface of said incoming rod, about a second axis parallel to said first axis, the central axis of said rod when grasped being perpendicular to a plane common to said first and said second axes, whereby said rod is formed into a shape determined by said grasping and projection application; and d. providing a die having an orifice smaller than transverse dimensions of the rod, locating said die in a zone defined at one extremity by a plane passing through said axes and the other extremity being spaced from said plane by a distance less than the radius of said member.

21. Apparatus for forming wire comprising:

a. first roller means having a circumferential groove with a width somewhat less than that of an incoming rod to be worked upon, whereby said incoming rod can be frictionally held by said groove of said first roller means, said first roller means being rotatable about a first axis;

b. second roller means rotatable about a second axis, said second axis being parallel to said first axis, said second roller means having a circumferential projection thereon, said first and said second roller means being so oriented so that said projection and said groove, when in cooperating relationship, form an opening therebetween, said opening at a plane common to said first and said second axes having a cross-sectional area less than that of the cross-sectional area of said incoming rod to be worked upon whereby said incoming rod when forced within said opening becomes upset;

c. motor means connected to said first roller means for rotating said first roller means; and d. a die fixed in location with respect to both said roller means so that said upsetted rod, when fed thereto by both said roller means, is extruded through said fixed die to form wire therefrom, said die location being immediately adjacent said opening so that the upsetted rod is fed directly from said opening to said die.

22. In apparatus for extruding wire from an incoming rod of material, including a circular, rotatable roller having a groove formed about its periphery, and a fixed shoe having an inner curved surface arranged to fit closely up against said roller periphery opposite said groove so as to form a grooved container having an inlet end circumferentially spaced about said roller from an outlet end, said shoe carrying an extrusion die at the outlet end of said container, said surface being closer to the bottom of said groove adjacent said die as compared with the corresponding radial distance at said inlet end so that the gap between the bottom of said groove and said inner curved surface of said shoe gradually reduces as the die is approached from said inlet end.

* * * * *